US008151785B2

(12) United States Patent
Dang

(10) Patent No.: US 8,151,785 B2
(45) Date of Patent: Apr. 10, 2012

(54) ADJUSTABLE HEIGHT STOVE GUARD

(76) Inventor: Qi Dang, Union City, CA (US)

( * ) Notice: Subject to any disclaimer, the term of this patent is extended or adjusted under 35 U.S.C. 154(b) by 338 days.

(21) Appl. No.: 12/587,276

(22) Filed: Oct. 5, 2009

(65) Prior Publication Data

US 2011/0079208 A1 Apr. 7, 2011

(51) Int. Cl.
*F24C 15/12* (2006.01)
*F24C 3/12* (2006.01)
*F24C 15/36* (2006.01)

(52) U.S. Cl. ..... 126/42; 126/214 D; 126/201

(58) Field of Classification Search ..... 126/42, 126/201, 211, 214 D, 218, 220, 221; 248/72, 248/74.1, 74.2, 74.3
See application file for complete search history.

(56) References Cited

U.S. PATENT DOCUMENTS

| | | | | | |
|---|---|---|---|---|---|
| 958,525 | A | * | 5/1910 | O'Donohoe | 126/42 |
| 2,674,772 | A | * | 4/1954 | Jacobs | 24/115 R |
| 3,931,919 | A | * | 1/1976 | Gerber et al. | 224/324 |
| 4,157,705 | A | | 6/1979 | Caan | |
| 4,322,087 | A | * | 3/1982 | Addicks | 280/279 |
| 4,469,019 | A | * | 9/1984 | Baer | 99/339 |
| 4,517,955 | A | | 5/1985 | Ehrlich | |
| 4,836,181 | A | | 6/1989 | Saga | |
| 4,964,393 | A | * | 10/1990 | Knudsen | 126/211 |
| 5,076,255 | A | * | 12/1991 | Harrison | 126/42 |
| 5,117,807 | A | * | 6/1992 | Graulich | 126/190 |
| 5,546,928 | A | * | 8/1996 | Lewis et al. | 126/214 D |
| 5,664,554 | A | * | 9/1997 | Martin | 126/201 |
| 5,758,636 | A | | 6/1998 | Butrimas | |
| 5,842,464 | A | | 12/1998 | Koch | |
| 5,931,423 | A | * | 8/1999 | Heideloff | 248/74.4 |
| 6,131,938 | A | * | 10/2000 | Speer | 280/506 |
| 6,173,926 | B1 | * | 1/2001 | Elvegaard | 248/74.1 |
| 6,298,629 | B1 | * | 10/2001 | Ador | 52/698 |
| 6,371,105 | B1 | * | 4/2002 | Merritt | 126/42 |
| 6,595,472 | B1 | * | 7/2003 | Pisczak | 248/74.1 |
| 6,782,761 | B2 | * | 8/2004 | Imai et al. | 73/861.27 |
| 6,851,820 | B2 | * | 2/2005 | Choi et al. | 362/92 |
| 7,549,417 | B2 | | 6/2009 | Dang | |
| 7,624,730 | B2 | | 12/2009 | Dang | |
| 2006/0249636 | A1 | * | 11/2006 | Thiedig et al. | 248/74.4 |
| 2007/0283822 | A1 | * | 12/2007 | Sheridan | 99/441 |
| 2008/0095573 | A1 | * | 4/2008 | Hewett et al. | 403/190 |
| 2008/0135036 | A1 | * | 6/2008 | Dang | 126/42 |
| 2008/0163859 | A1 | * | 7/2008 | Dang | 126/42 |

* cited by examiner

*Primary Examiner* — Kenneth Rinehart
*Assistant Examiner* — Joanna Davis

(57) ABSTRACT

A stove (or range) burner guard attached to the front of a gas or electrical stove (or range) by fastening a guard panel through two vertical slots to a clamping body that is attached to the oven door handle. The height of the guard panel is adjustable by sliding the guard panel through the vertical slots. The guard prevents young children from reaching the burners, control knobs and cookware on the stovetop. The guard can be installed, adjusted or removed quickly and easily.

1 Claim, 5 Drawing Sheets

ADJUSTABLE HEIGHT STOVE GUARD

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

1. Field of Invention

The invention is related to an adjustable height stove burner guard, which prevents small children from reaching the burners, control knobs and cookware on the stovetop. The guard also prevents small children from coming in contact with heated liquid or other foods that may bubble or splash from cookware on the stovetop. The height of the guard panel is adjustable to accommodate the height of the stove user and can be installed, adjusted or removed quickly and easily.

2. Description of the Prior Art

A patent application was filed by and awarded to the present inventor for a quick install/remove stove guard. The guard panel in the previous design consists of a one-piece sheet of material, and the width of the lower portion of the panel is reduced to fit the door handle of the oven door. The width of the lower portion of the guard panel can not be changed once the panel is made. This creates the possibility that the panel will not fit within some oven door handles, limiting the application of that stove guard design to certain types of the stoves. The new design solves this problem by using two clamping devices attached to the oven door handle. The guard panel is fastened to the clamping device through two vertical slots on the guard panel. The height of the guard panel can be adjusted through the vertical slots located on the lower bottom of the panel.

Other stove guards were invented in the prior art to prevent small children from reaching the stove burners, control knobs and cookware while cooking as listed on the following list:

| | | |
|---|---|---|
| 4,157,705 | June 1979 | Caan |
| 4,517,955 | May 1985 | Ehrlich et al. |
| 4,836,181 | June 1989 | Saga |
| 5,546,928 | August 1996 | Lewis et al. |
| 5,758,636 | June 1998 | Butrimas et al. |
| 5,842,464 | December 1998 | Koch |
| 7,549,417 | June 2009 | Dang |

Those devices described in the prior art often require complicated installation procedures. Once installed, the devices are difficult to remove for cleaning. In some cases, the guard panels are attached to the top of the stove surface, making the guard panel vulnerable to heat damage.

The complicated installing and removing devices referred to above make those guards less likely to be used on a regular basis when small children are present, and this departs from the purpose of the inventions. Therefore, new and improved stove guards are needed to overcome the disadvantages of the existing inventions. The current invention, like the June 2009 Dang patent addresses this need.

SUMMARY OF THE INVENTION

The objective of this invention is to provide a reliable and simple way to install a stove guard on most ovens to prevent small children from reaching the stove burners, control knobs and cookware while cooking. The present invention provides an adjustable height stove guard that can be easily and quickly installed. The simple installation procedure and the ability to adjust the height increase the likelihood that parents and other caregivers of small children will use the guard more frequently. Two clamping devices are attached to the oven door handle, and the guard panel is fastened to the clamping devises through the vertical slots located in the lower bottom of the panel. The height of the guard panel can be adjusted by moving the panel along the vertical slots.

The guard panel is not attached to the top surface of the stove where the burners are located, thus minimizing the chance that heat damage to the guard panel will occur during use. In addition, the guard panel is bent outward to increase rigidity of the panel and to provide more room for cookware.

BRIEF DESCRIPTION OF THE DRAWING FIGURES

Figure 6:
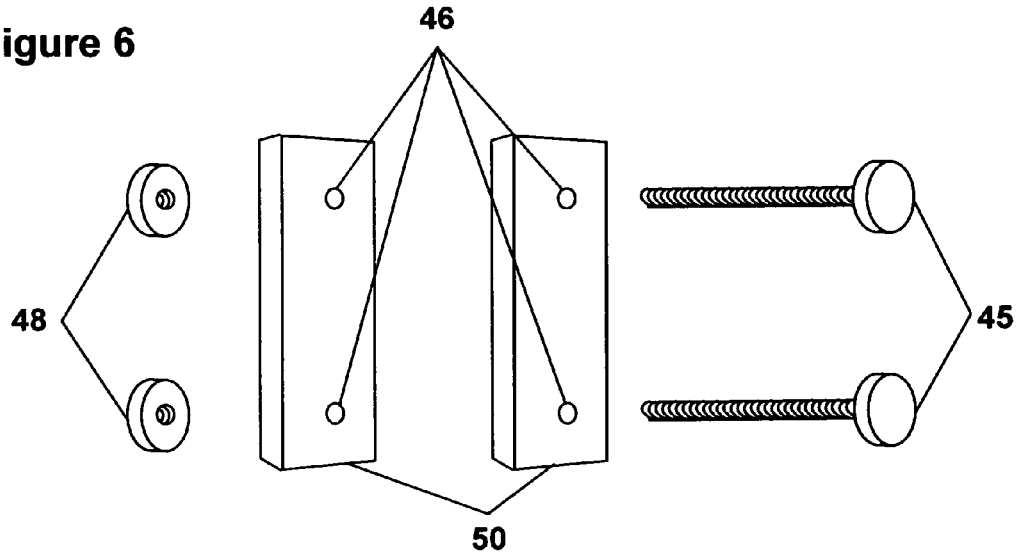

FIG. 6 is the view of one of the two identical clamping devices. Two round penetrating holes are drilled through the upper and lower portions of the panel clamping bodies. The diameter of the hole is slightly larger than the diameter of the bolt. Two flat head bolts and two corresponding fastening knobs with threaded insert are also shown.

Figure 7:
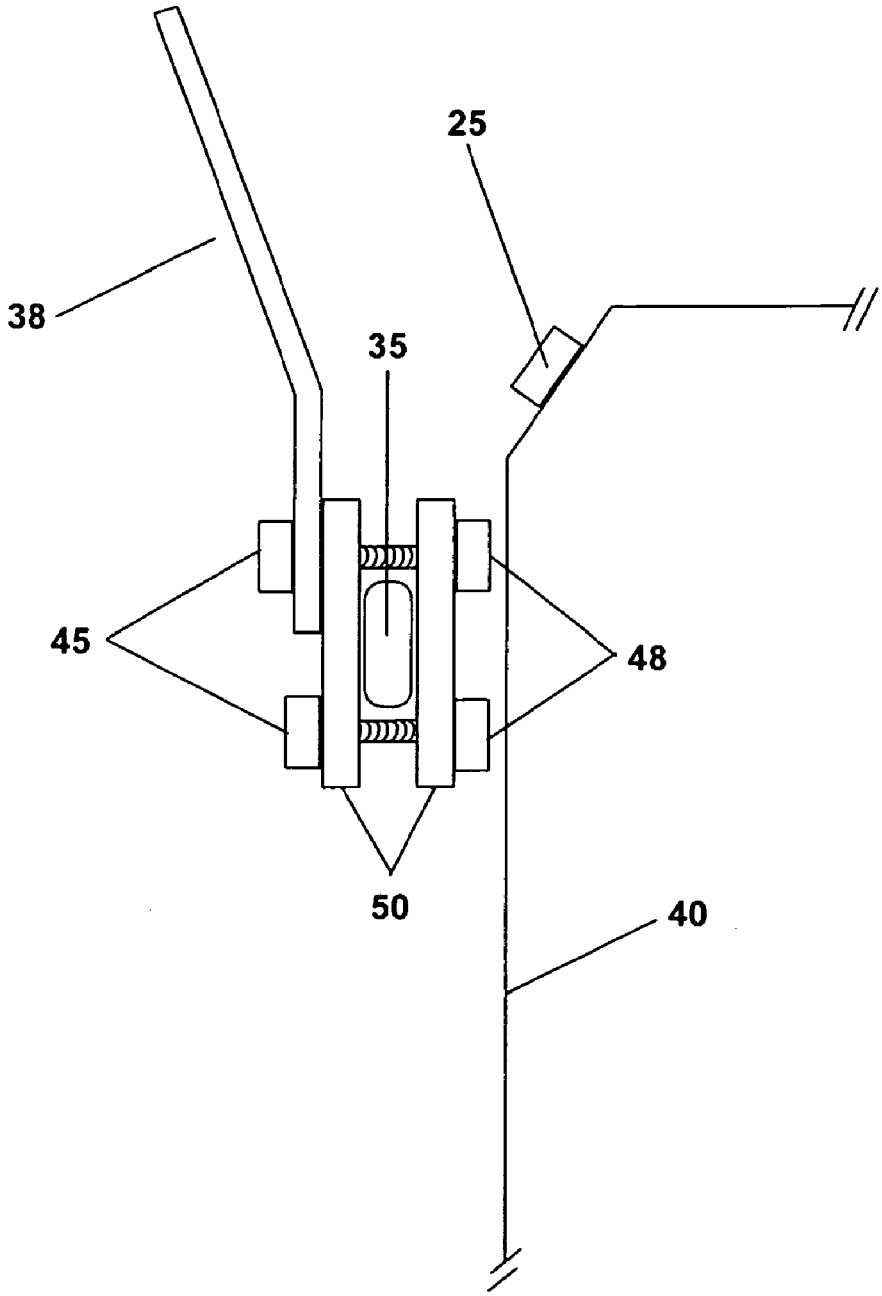

FIG. 7 is the cross section view of the installed guard panel. The bottom edge of the guard panel is fastened to the outer clamping bodies that are fastened to the oven door handle.

DESCRIPTION OF THE PREFERRED EMBODIMENT

The invention provides a new and improved design of an adjustable height stove guard. For the purposes of promoting an understanding of the principles of the invention, reference will now be made to the embodiments illustrated in the drawings referred to as FIGS. 1 to 7.

Figure 1:
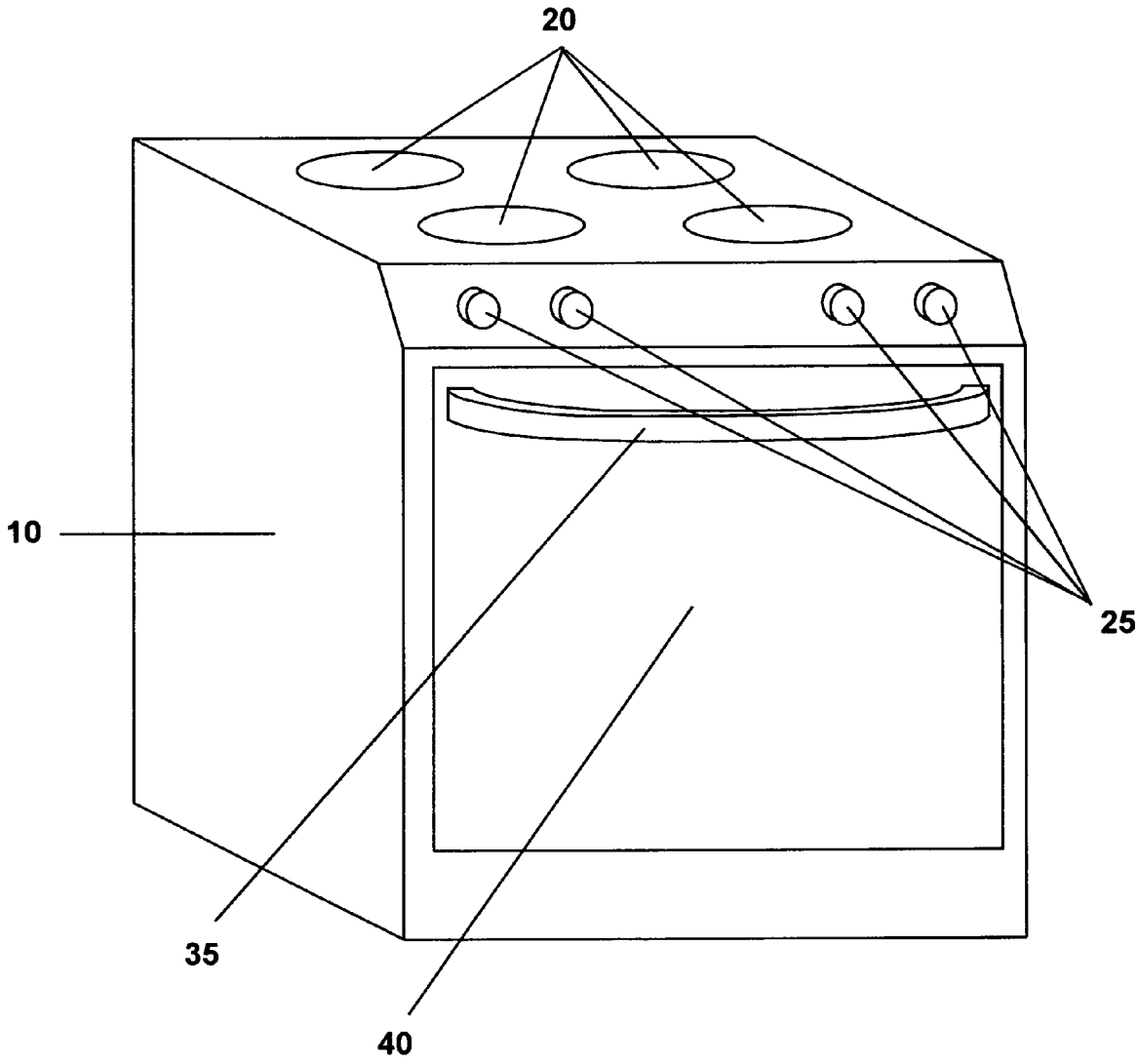
FIG. 1 is a view of a stove/range with burners on the top and an oven with the door handle located beneath the burners. Control knobs are located in the upper front of the range.

FIG. 1 is a view of a typical range 10. Burners 20 are located on the top of the range 10. Control knobs 25 are located in the upper front of the range. The oven is located beneath the burner top. A hinged oven door 40 is located in the front of the oven. An elongated C-shaped oven door handle 35 is attached to the upper portion of the oven door.

Figure 2:
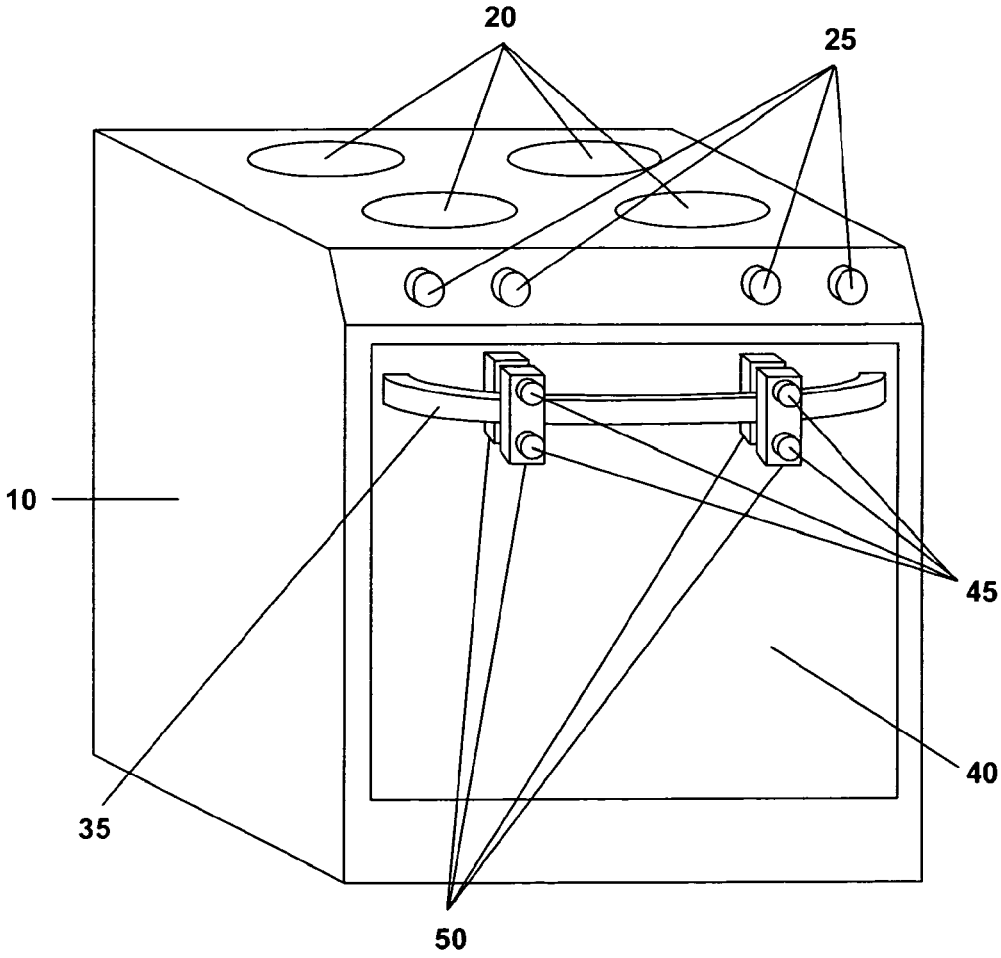
FIG. 2 is the perspective view of the range with the clamping devices fastened to the oven door handle.

FIG. 2 is the perspective view of the range with two sets of clamping bodies 50 fastened to the oven door handle 35, each with two bolts 45.

Figure 3:
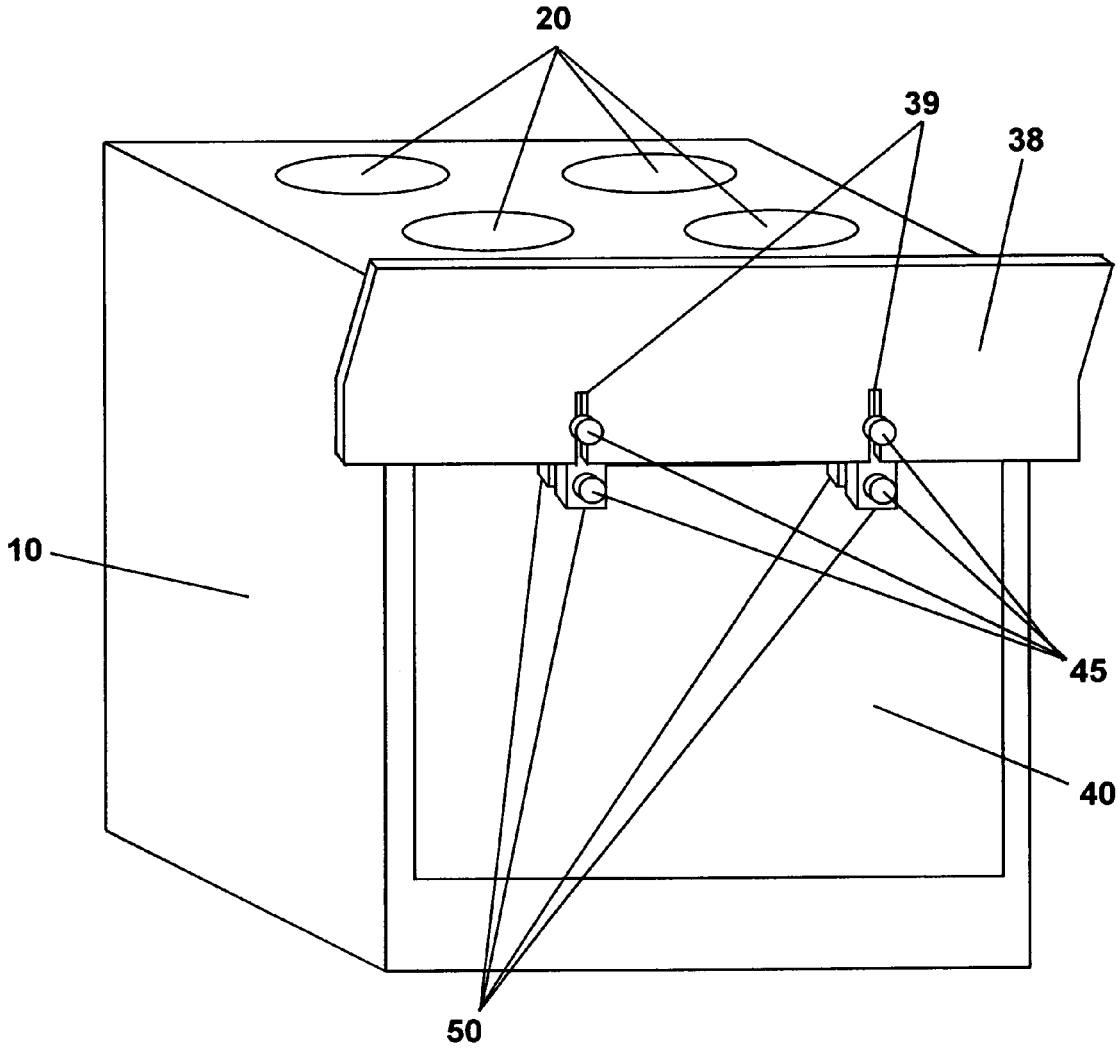
FIG. 3 is the perspective view of the range with the guard panel attached to the clamping devices which are fastened to the oven door handle.

FIG. 3 is the perspective view of the range with stove guard panel 38 fastened to the two sets of clamping bodies 50 by the two top-most bolts 45 through the two vertical slots 39 located in the lower bottom of the guard panel 38.

Figure 4:
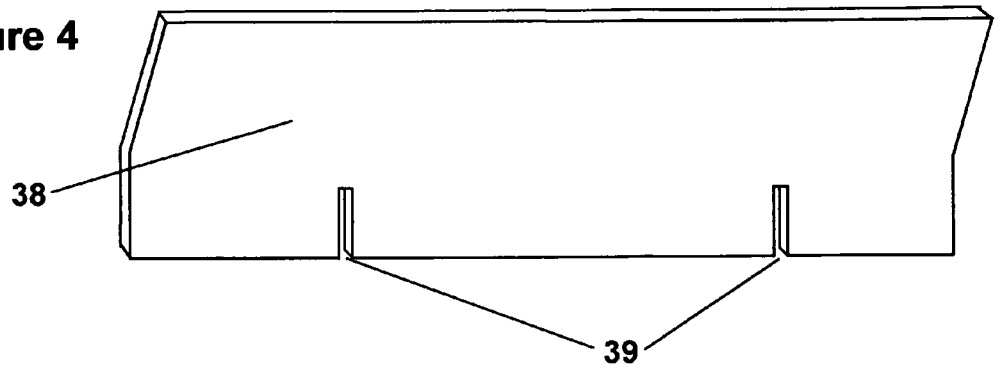
FIG. 4 is the front view of the guard panel. Two vertical slots are located in the lower portion of the guard panel.

FIG. 4 is the front view of the guard panel 38. The upper portion of the panel 38 is bent outward so that when installed, it provides more room for the cookware. This also increases the rigidity of the guard panel. Two identical vertical penetrating slots 39 are made at the lower edge of the guard panel 38.

Figure 5:
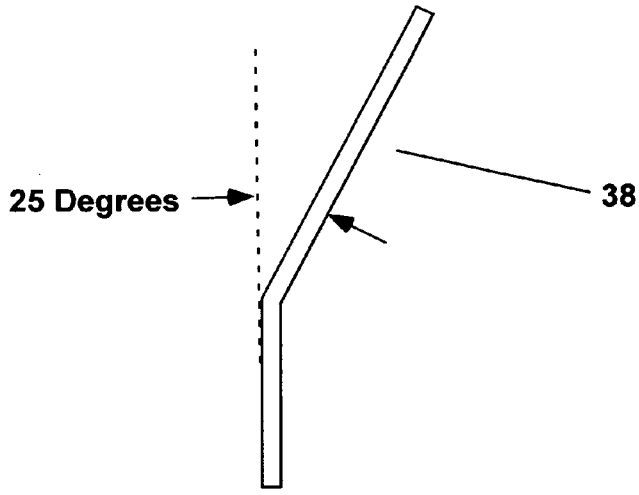
FIG. 5 is the side view of the guard panel. The upper portion of the panel is bent outward about 25 degrees.

FIG. 5 is the side view of the guard panel 38. The upper portion of the panel 38 is bent by about 25 degrees. This increases the rigidity of the guard panel and provides more room for cookware on the stovetop.

FIG. 6 is the view of one of the two identical clamping devices (50, 48 and 45). The two clamping bodies 50 are rectangular in shape. Two round penetrating holes 46 are drilled through the upper and lower portions of the clamping bodies 50. The diameter of the hole 46 is slightly larger than the diameter of the bolt 45. Two flat head bolt 45 and two corresponding fasting knobs 48 with threaded insert are also shown.

FIG. 7 is the side view of one of the two identical clamping devices (50, 48 and 45) with the guard panel 38 fastened to them. The upper portion of the panel is bent outward by about 25 degrees to provide extra space for cookware handles and to reduce the chance that the guard panel will be damaged by heat.

The guard panel 38, and clamping bodies 50 can be made of plastic, aluminum, other metals or other durable materials.

What are claimed:

1. A stove guard assembly that allows for vertical height adjustment comprising: a guard panel with an upper rectangular portion and a lower rectangular portion, said upper and lower rectangular portions having a width greater than a width of the stove, said upper rectangular portion being inclined outwardly from the stove and said lower rectangular portion having two identical vertical slots that run parallel to the vertical edge of the stove guard and allow for vertical height adjustment of the stove guard; wherein the two identical vertical slots of said lower rectangular portion are adjustably attached to two clamping assemblies that fasten around a handle of said oven door via bolt attachment; wherein each clamping assembly comprises two clamping bodies that are placed on opposite sides of the handle of the oven door when the clamping assembly is assembled, each clamping body having a perforated bolt hole located at an upper end and a perforated bolt hole located at a lower end, each clamping body having a bolt passed through the upper perforated bolt hole and located above the handle of the oven door when the clamping assemblies are assembled and a bolt passed through the lower perforated bolt hole and located below the handle of the oven door when the clamping assemblies are assembled, each bolt having a corresponding fastener that faces the oven door when the clamping assemblies are assembled; wherein the bolts located in the upper perforated bolt holes are slid inside the two identical vertical slots of the lower rectangular portion of the stove guard allowing for attachment of the stove guard to the clamping assemblies; wherein the bolts passed through the upper perforated bolt holes provide a clamping force when the bolts and corresponding fasteners are tightened.

* * * * *